US010015874B2

(12) United States Patent
Mishin

(10) Patent No.: US 10,015,874 B2
(45) **Date of Patent: *Jul. 3, 2018**

(54) HYBRID STANDING WAVE LINEAR ACCELERATORS PROVIDING ACCELERATED CHARGED PARTICLES OR RADIATION BEAMS

(71) Applicant: VAREX IMAGING CORPORATION, Salt Lake City, UT (US)

(72) Inventor: Andrey Mishin, Salt Lake City, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/456,057

(22) Filed: Mar. 10, 2017

(65) Prior Publication Data

US 2017/0265292 A1 Sep. 14, 2017

Related U.S. Application Data

(63) Continuation-in-part of application No. 15/068,355, filed on Mar. 11, 2016, now Pat. No. 9,854,662.

(51) Int. Cl.
*H05B 31/26* (2006.01)
*H05H 9/02* (2006.01)
(Continued)

(52) U.S. Cl.
CPC ..... *H05H 9/02* (2013.01); *H05H 7/02* (2013.01); *H05H 7/04* (2013.01); *H05H 7/22* (2013.01);
(Continued)

(58) Field of Classification Search
CPC .. H05H 9/00; H05H 7/00; H05H 7/02; H05H 7/18; H05H 5/00; H05H 7/04;
(Continued)

(56) References Cited

U.S. PATENT DOCUMENTS 2,920,228 A 1/1960 Ginzton
3,019,400 A 1/1962 Garver
(Continued)

FOREIGN PATENT DOCUMENTS

CN 1455635 11/2003
CN 202019491 U 10/2011
(Continued)

OTHER PUBLICATIONS

Notice of Allowance dated Aug. 15, 2017 which issued in U.S. Appl. No. 15/068,355.
(Continued)

*Primary Examiner* — Minh D A
(74) *Attorney, Agent, or Firm* — Cozen O'Connor; Brandon N. Sklar

(57) ABSTRACT

A hybrid linear accelerator is disclosed comprising a standing wave linear accelerator section ("SW section") followed by a travelling wave linear accelerator section ("TW section"). In one example, RF power is provided to the TW section and power not used by the TW section is provided to the SW section via a waveguide. An RF switch, an RF phase adjuster, and/or an RF power adjuster is provided along the waveguide to change the energy and/or phase of the RF power provided to the SW section. In another example, RF power is provided to both the SW section and the TW section, and RF power not used by the TW section is provided to the SW section, via an RF switch, an RF phase adjuster, and/or an RF power. In another example, an RF load is matched to the output of the TW section by an RF switch.

28 Claims, 5 Drawing Sheets

(51) Int. Cl.

| | |
|---|---|
| ***H05H 9/04*** | (2006.01) |
| ***H05H 7/02*** | (2006.01) |
| ***H05H 7/04*** | (2006.01) |
| ***H05H 7/22*** | (2006.01) |

(52) U.S. Cl.
CPC ..... *H05H 9/04* (2013.01); *H05H 2007/025* (2013.01); *H05H 2007/041* (2013.01); *H05H 2007/222* (2013.01)

(58) Field of Classification Search
CPC . H05H 11/00; H05H 7/06; H05H 9/04; G21K 1/093; H01J 25/00
See application file for complete search history.

(56) References Cited

U.S. PATENT DOCUMENTS

| | | | | |
|---|---|---|---|---|
| 3,070,726 | A | 12/1962 | Mallory | |
| 3,417,505 | A * | 12/1968 | Schultz | A63H 33/102 428/542.2 |
| 4,118,653 | A | 10/1978 | Vaguine | |
| 4,286,192 | A | 8/1981 | Tanabe et al. | |
| 5,661,377 | A | 8/1997 | Mishin et al. | |
| 6,864,633 | B2 | 3/2005 | Trail et al. | |
| 7,538,325 | B2 | 5/2009 | Mishin et al. | |
| 8,942,351 | B2 | 1/2015 | Cheung et al. | |
| 2003/0141448 | A1 | 7/2003 | Symons | |
| 2005/0205772 | A1 | 9/2005 | Zavadstev et al. | |
| 2007/0274445 | A1 | 11/2007 | Zavadstev et al. | |
| 2007/0296530 | A1 | 12/2007 | Heisen et al. | |
| 2008/0211431 | A1 | 9/2008 | Mishin et al. | |
| 2014/0185775 | A1 | 7/2014 | Tang et al. | |
| 2016/0014877 | A1 | 1/2016 | Sugahara et al. | |
| 2017/0265293 | A1 * | 9/2017 | Mishin | H05H 9/047 |

FOREIGN PATENT DOCUMENTS

| | | |
|---|---|---|
| KR | 20150055439 | 5/2015 |
| SU | 1374454 | 2/1988 |
| SU | 1119599 | 3/1988 |
| WO | WO 2016/091940 | 6/2016 |

OTHER PUBLICATIONS

Armistead et al., "Microwave Semiconductor Switch," Diamond Ordnance Fuze Labs, Washington 25, D.C., Proceedings of the IRE Dec. 1956, p. 1875.

Uebele, G.S., "High-speed, Ferrite Microwave Switch," 1957 IRE National Convention Record, vol. 5, pt. 1, pp. 227-234, Proceedings IRE Transactions on Microwave Theory and Techniques, Jan. 1959, p. 73-82.

Haimson, J., "Some Aspects of Electron Beam Optics and X-Ray Production with the Linear Accelerator," IRE Transactions on Nuclear Science 10 1109 TNS2431598, pp. 32-49, 1962.

Vaguine, V.A. "Electron Linear Accelerator Structures and Design for Radiation Therapy Machines," IEEE Transactions on Nuclear Science, vol. NS-28, No. 2, pp. 1884-1888, Apr. 1981.

Segall, S.B., "Hybrid Accelerator Design for a Free Electron Laser," IEEE Transactions on Nuclear Science, vol. NS-32, No. 5 Oct. 1985.

Miller et al., "Comparison of Standing-Wave and Traveling-Wave Structures," Presented at the Stanford Linear Accelerator Conference, Stanford, California on Jun. 2-6, 1986.

O'Shea et al., RF Design of the UCLA/INFN Hybrid SW/TW Photoinjector, Advanced Accelerator Concepts (1995), Proceedings, pp. 1-7, Sep. 22, 2006.

Bigolas et al., "The SW Accelerating Structure of Variable Energy Electron Linac for Medical Application," Proceedings of the 2001 Particle Accelerator Conference, Chicago, pp. 2790-2792, 2001.

Hanna, S., "Review of Energy Variation Approaches in Medical Accelerators," Proceedings of EPAC08, Genoa, Italy, pp. 1797-1799, 2008.

Fukasawa et al., "Beam Dynamics and RF Cavity Design of a Standing/Traveling-Wave Hybrid Photoinjector for High Brightness Beam Generation," Proceedings of PAC09, Vancouver, BC, Canada pp. 4434-4436, 2009.

Zavadstev et al., "A Dual-Energy Cargo Inspection System," Instruments and Experimental Techniques 54(2), 2011, Proceedings of 2011 Particle Accelerator Conference, New York, NY, USA, p. 241-248.

Kutsaev et al., "Hybrid Electron Linac Based on Magnetic Coupled Accelerating Structure," Proceedings of 2011 Particle Accelerator Conference, New York, NY USA, pp. 2136-2138, 2011.

Matsievskiy et al., "Hybrid Electron Linac with Standing and Travelling Wave Accelerating Sections," Proceedings of IPAC, 2016, Busan, Korea, pp. 1791-1793.

Rosenzweig et al., "Bean Dynamics in a Hybrid Wave Traveling Wave Photoinjector,"UCLA Dept. of Physics and Astronomy, Los Angeles, CA, 2006, (7 pages).

Kutsaev et al., "Design of Hybrid Electron Linac with Standing Wave Buncher and Traveling Wave Structure," Nuclear Instruments and Methods in Physics Research A, 636 (2011), pp. 13-30.

International Search Report and Written Opinion dated May 11, 2017 issued in International Patent Application No. PCT/US2017/021895.

Pirozhenko, "Efficient Traveling-wave Accelerating Structure for Linear Accelerators," EPAC 2008, Genoa, Italy, 11$^{th}$ European Particle Accelerator Conference, pp. 2746-2748, 2008.

* cited by examiner

HYBRID STANDING WAVE LINEAR ACCELERATORS PROVIDING ACCELERATED CHARGED PARTICLES OR RADIATION BEAMS

RELATED APPLICATION

The present application is a continuation-in-part of U.S. patent application Ser. No. 15/068,355, which was filed on Mar. 11, 2016, is assigned to the assignee of the present invention, and is incorporated by reference herein.

FIELD OF THE INVENTION

Embodiments of the invention relates generally to linear accelerators for providing electron beams or x-ray beams, and particularly to such linear accelerators including a standing wave section and a traveling wave section following the standing wave section in a collinear relationship.

BACKGROUND OF THE INVENTION

Linear Accelerators (also called "LINACS") are widely used for a variety of tasks in a broad range of applications, including industrial applications such as Non-Destructive Testing (NDT), Security Inspection (SI), Radiotherapy (RT), electron beam processing —sterilization, and polymer curing, for example. Both accelerated electron beams, and Bremsstrahlung X-ray beam generated by such electron beams striking a conversion target at the end of an accelerating channel, are used for various tasks. The type of radiation beam selected is typically determined by the specific application and its requirements. In many applications, the requirements include energy variation and dose rate variation of the radiation beam, including broad RB energy variation, for example, from 0.5 MeV to a maximum energy, which typically does not exceed 10 MeV due to neutron production and activation problems. However, in some known cases, it can reach as high as 12 MeV, 15 MeV, 20 MeV, or even higher energies. Those familiar with the art are well aware that a linear accelerator is a sophisticated tool that does not always run efficiently, or does not perform at all over such a broad radiation beam operating energy range.

A linear accelerator includes a plurality of cavities, which gradually increase in length in the direction of the electron beam propagation to keep the particles in the right accelerating phase while their velocity increases. Once electron velocity reaches nearly the speed of light, the period of the structure and the shape of the accelerating cells usually remain the same until the end of the accelerator.

The front irregular section of the linear accelerator where electron velocities change substantially (from about 20% to 95% of the speed of light), and where the electrons are grouped together as a stream of bunches of electrons, is typically called the "buncher". The buncher is responsible for forming the relativistic electron beam, which then enters the regular periodic part of the linear accelerator structure, called the "accelerator", where the velocity of the electrons does not change substantially, while they reach higher energies above 1 MeV, and up to the N×10 MeV range or higher (where N is an integer 1, 2 . . . N).

An important parameter used for defining efficiency of the buncher is called "capture", which presents a percentage of the particles captured by the accelerating fields, and synchronously accelerated to the required energy with respect to a total number of particles injected into the structure. Capture is very sensitive to the accelerating field distribution in the buncher. While one attempts regulating output energy of the produced radiation beam by varying input RF power into the linear accelerator, the structure of the fields in the buncher change, and the electron beam current in the accelerating channel may be reduced substantially due to degradation of capture in the buncher, thereby reducing intensity of the produced radiation beam.

The same may be true for regulating the radiation beam energy via switching of the injected electron beam pulse current without optimizing power and field distribution along the linear accelerator. The optimization is especially important for magnetron-driven linear accelerators, which represent most of the commercial markets. The optimization is even more important, for higher frequency linear accelerators designed to operate with an X-band power source, for examples, where lack of the input RF power generated by the best commercially available X-band magnetrons for a given task exists in most, if not all cases (so-called "power hungry" mode of operation).

An example of a standing wave linear accelerator known in the art is shown schematically in FIG. 1. The linear accelerator comprises a plurality of single RF cavities (not shown) coupled together in various ways depending on the RF structure design. RF power is provided by the RF power source 1, such as a magnetron or a klystron. The RF power propagates through an RF transmitting waveguide 2 and a high power circulator 3 to an input RF coupler 4, which is configured to match impedance of the external and internal RF circuit to minimize power reflections at the operating RF frequency. A high power circulator 3 prevents reflected power from propagating back to the RF source 1. The circulator 3 is called a "high power" circulator rather than a "low power" circulator because it is adapted for the maximum possible power generated by the RF source 1. Therefore, most of the RF power from the RF source 1 enters the linear accelerator.

In FIG. 1, the linear accelerator has two single RF structures coupled together, a standing wave buncher section 6 (or "buncher 6") and a standing wave accelerator section 7 (or "accelerator 7"). The buncher section 6 contains a sequence of cavities, which are different in length to maintain proper phase shift between the accelerating fields in the neighboring cells to accommodate the gradually increasing electron velocity. The electron velocity rapidly increases to relativistic values (close to the speed of light) in the standing wave buncher section 6. Since the electron velocity becomes nearly constant in the accelerator section 7, all the cells have the same length. The RF source is powered by one or more sources (not shown), as is known in the art.

The single RF cavity of the input RF coupler 4 is also part of the linear accelerator RF structure. In the case of the standing wave linear accelerator, the input RF coupler 4 is usually placed somewhere after the buncher 5 and before accelerator 7, although it may be positioned anywhere along the linear accelerator. In the linear accelerator of FIG. 1, the buncher 5, the input RF coupler 4, and the accelerator section 7 together provide a single RF coupled accelerating structure of the linear accelerator. The RF power provided by the RF source is distributed among the linear accelerator cavities in accordance with the linear accelerator configuration and its RF properties, forming an RF field distribution for accelerating the charged particles, such as the electrons.

An electron beam 10 is formed in an electron gun 11, which can operate in a range of high voltages N×(1, 2, 3 . . . 100) kV, forming an electron beam 10 having a diameter small enough to enter the buncher 6. The electron beam 10 gains energy while propagating through the RF fields of the linear accelerator cavities of the buncher 6 and the accelerator section 7. After the electron beam 10 exits the RF accelerating structure, the electron beam is extracted outside the vacuum envelope of the linear accelerator through a vacuum-tight thin foil for electron beam applications, or it strikes a heavy metal target to generate bremsstrahlung (X-rays), as is known in the art. The election gun 11 may be a diode or triode election gun for example, as is known in the art. The electron gun 11 may be powered by the same power supply that powers the RF source or another power supply (not shown), as is also known in the art.

An optional external magnetic system 13, such as a focusing solenoid or a permanent periodic magnet ("PPM") system, may be used. The magnetic system 13 may also include steering coils, bending magnets, etc., for correction of beam positioning inside the linear accelerator, or at its exit via electron beam window or conversion target 12. Use of an external focusing system is undesirable because it increases complexity and power consumption, and consequently increases the cost of the linear accelerator system. In standing wave linear accelerator systems, use of a magnetic system 13 can be avoided. In traveling wave linear accelerators, in contrast, a magnetic system 13 is provided in most cases, especially for the buncher portion of a linear accelerator.

To regulate energy in the standing wave linear accelerator of FIG. 1, which has a single RF feed from the RF source 1, field amplitude in the linear accelerator RF structure may be changed by varying beam loading or by varying input power regulation. Analysis of performance is shown in FIG. 2, which is a graph of Electron Beam Energy versus Peak Electron Beam Current (bottom axis) and Load Line and Dose Rate (top axis). FIG. 2 shows changes to a theoretical linear accelerator load line (squares) in a first approximation (Energy, MeV) to a corrected load line based on Parmela simulations of beam dynamics (diamonds). No external magnetic focusing field is provided. The graph of FIG. 2 also shows the corresponding dose rate curve (X's and triangles, respectively) based on the first linear load line (Dose Rate, R/min@1 m) and the other dose rate curve (or function) that corresponds to the load line based on Parmela calculations (Parmela/Dose). The effect of beam dynamics on output radiation beam characteristics is evident.

A reduced complexity and reduced cost linear accelerator is typically preferred. It is easier to design a standing wave linear accelerator to avoid use of the external focusing than it is to design a traveling wave linear accelerator without such focusing. While a traveling wave linear accelerator delivers some properties superior to those of a standing wave linear accelerator, it usually requires a focusing solenoid. A traveling waveguide principal behavior will be similar to that for the standing wave, described above.

Due to a common deficit of RF power, linear accelerators are usually designed for near maximum optimal output energy, where the dose rate is at its maximum defined by a well-known empirical ratio as follows:

$$P=70\times I\times W^{n}, \tag{1}$$

where: P is the Bremsstrahlung dose rate at 1 meter from a heavy metal conversion target, in R/min; I is the average electron beam current striking the target, in mA; W is the electron beam energy, in MeV; and n is a parameter that varies with energy (in several MeV range it is approximately 2.7).

For linear accelerators using an electron beam in a broad energy range, it is important to increase capture and efficiency at lower energy, thereby increasing the accelerated beam current and electron beam dose rate of the radiation beam. Where the linear accelerator is equipped with a conversion target to produce Bremsstrahlung radiation, the conversion dose rate is proportional to current, and nearly to a cube of energy. Consequently, lower energy operation of the linear accelerator at higher beam current becomes even more important. Efficient operation at lower energy is difficult to achieve, if the linear accelerator is designed to provide a beam at maximum energy at a given beam current to obtain the best radiation beam output.

SUMMARY OF THE INVENTION

In accordance with an embodiment of the invention, a hybrid linear accelerator includes a collinear standing wave linear accelerator section and a traveling wave linear accelerator section with energy and dose regulation to optimize the output beam energy and dose rate over a range of energy values. Embodiments include the hybrid linear accelerator connected via RF waveguides in parallel or in series, in a direct or a reverse sequence, with an RF switch, phase shifter, and/or power adjuster to redirect and redistribute RF power between sections of the linear accelerator and/or change a phase shift between these sections. In another embodiment, an RF load is matched to an output of the traveling wave section via an RF switch.

In accordance with an first embodiment of the invention, a hybrid linear accelerator comprises a source of charged particles configured to provide an input beam of charged particles and a standing wave linear accelerator section configured to receive the input beam of charged particles and to accelerate the charged particles to provide an intermediate beam of accelerated electrons. A traveling wave linear accelerator section is configured to receive the intermediate beam of accelerated electrons, and to further increase the momentum and energy of the accelerated electrons. The traveling wave linear accelerator section provides an output beam of charged particles. A drift tube is provided between the standing wave linear accelerator section and the traveling wave linear accelerator section. The drift tube is configured to provide a path to for passage of the intermediate beam from the standing wave linear accelerator section to the traveling wave linear accelerator section and to RF decouple the standing wave linear accelerator section from the traveling wave linear accelerator section. The hybrid linear accelerator further comprises an RF source configured to provide RF power to the traveling wave accelerator section to further increase the momentum and energy of the intermediate beam of charged particles. A waveguide is provided with an input coupled to an output of the traveling wave linear accelerator section and an output coupled to an input of the standing wave linear accelerator section. RF power remaining after attenuation in the traveling wave linear accelerator section is fed to the standing wave linear accelerator section to accelerate the charged particles.

The hybrid linear accelerator may further comprise an RF switch, an RF phase shifter, and/or an RF power adjuster along the waveguide, to change the power and/or phase of the RF power provided to the standing linear accelerator section. The RF switch, RF phase shifter, and/or RF power adjuster may be configured to provide energy regulation of from about 0.5 MeV to a maximum linear accelerator energy.

The standing wave linear accelerator section may be configured in the form of a buncher, for example. The source of charged particles may comprise an electron gun configured to provide an input beam of electrons, for example. A first external magnetic system cooperative with the standing wave linear accelerator and/or a second external magnetic system cooperative with the traveling wave linear accelerator section, may be provided.

The hybrid linear accelerator in accordance with this embodiment may further comprise a second RF waveguide between the RF source and traveling wave linear accelerator section configured to provide RF power from the RF source to the traveling wave linear accelerator section. A high power circulator may be provided along the second RF waveguide to prevent reflected RF power from propagating back to the RF source, and/or a low power circulator may be provided along the first RF waveguide to prevent reflected RF power from propagating back to the traveling wave accelerator section. A charged particle beam window or a conversion target for producing Bremsstrahlung radiation may be provided downstream of the output of the traveling wave linear accelerator.

In accordance with a second embodiment of the invention, a hybrid linear accelerator is disclosed comprising a source of charged particles and a standing wave linear accelerator section configured to receive the input beam of electrons and accelerate the charged particles to provide an intermediate beam of accelerated charged particles. The hybrid linear accelerator further comprises a traveling wave linear accelerator section configured to receive the intermediate beam of accelerated charged particles, and to further increase the momentum and energy of the accelerated electrons. The traveling wave linear accelerator section provides an output beam of charged particles. A drift tube is provided between the standing wave linear accelerator section and the traveling wave linear accelerator section to provide RF decoupling between the standing wave standing wave linear accelerator section and the traveling wave linear accelerator section, while also permitting transit of the intermediate beam of accelerated electrons from the standing wave linear accelerator section to the traveling wave linear accelerator section. The hybrid linear accelerator further comprises an RF power source and an RF splitter that is configured to receive RF power from the RF power source and to bifurcate the RF power into a first portion of RF power to be provided to the standing wave accelerator section and a second portion of RF power to be provided to the traveling wave accelerator section.

The hybrid linear accelerator in accordance with this embodiment may further comprise at least one of an RF switch, an RF phase shifter, and an RF power adjuster configured to feed the standing wave linear accelerator section with RF power not used by the traveling wave linear accelerator section, and/or to change a phase relationship between the standing wave linear accelerator section and the traveling wave linear accelerator section. The RF switch, the RF phase shifter, and/or the RF power adjuster may be configured to provide energy regulation of from about 0.5 MeV to a maximum linear accelerator energy.

The standing wave linear accelerator section may be configured in the form of a buncher, for example. The source of charged particles may comprise an electron gun configured to provide an input beam of electrons, for example. A first external magnetic system cooperative with the standing wave linear accelerator and/or a second external magnetic system cooperative with the traveling wave linear accelerator section, may also be provided. A charged particle beam window or a conversion target for producing Bremsstrahlung radiation may be provided downstream of the output of the traveling wave linear accelerator.

The hybrid linear accelerator in accordance with this embodiment of the invention may further comprise an RF waveguide between the RF source and RF splitter. The RF waveguide is configured to provide RF power to the RF splitter and a high power circulator is further provided along the RF waveguide to prevent reflected RF power from propagating back to the RF source.

The hybrid linear accelerator in accordance with this embodiment may further comprise a matched RF load coupled to the traveling wave accelerator to absorb RF power remaining after acceleration in the traveling wave linear accelerator section. A charged particle window or a conversion target for producing Bremsstrahlung radiation may also be provided.

In accordance with a third embodiment of the invention, a hybrid linear accelerator is disclosed comprising a source of charged particles configured to provide an input beam of electrons and a standing wave linear accelerator section configured to receive the input beam of charged particles and accelerate the charged particles to provide an intermediate beam of accelerated charged particles. A traveling wave linear accelerator section configured to receive the intermediate beam of accelerated charged particles and to further increase the momentum and energy of the accelerated charged particles is also provided. The traveling wave linear accelerator section has an output. An RF coupler configured to provide RF coupling between the standing wave linear accelerator and the traveling wave linear accelerator section is provided to allow transit of the intermediate beam of accelerated electrons from the standing wave linear accelerator section to the traveling wave linear accelerator section. The hybrid linear accelerator further comprises an RF source configured to provide RF power to both the standing wave linear accelerator section and the traveling wave accelerator section via an RF waveguide cooperative with the RF coupler. An RF load is provided cooperative with the output of the traveling wave linear accelerator section. An RF switch is provided between the RF coupler and the RF load to match the RF load to the RF power output from the traveling wave linear accelerator section to absorb power remaining after attenuation in the wave linear accelerator. The RF switch may be configured to provide energy regulation of from about 0.5 MeV to a maximum linear accelerator energy, for example.

The standing wave linear accelerator section may be configured in the form of a buncher, for example. The source of charged particles may comprise an electron gun configured to provide an input beam of electrons, for example. A first external magnetic system cooperative with the standing wave linear accelerator and/or a second external magnetic system cooperative with the traveling wave linear accelerator section, may be provided.

An RF waveguide may be provided between the RF source and the RF coupler, and a high power circulator may be provided along the RF waveguide to prevent reflected RF power from propagating back to the RF source. A charged particle window or a conversion target for producing Bremsstrahlung radiation may also be provided.

In accordance with another embodiment of the invention, a method of accelerating charged particles by a hybrid linear accelerator comprising a standing wave linear accelerator section and a traveling wave linear accelerator section following the standing wave section is disclosed comprising providing charged particles to the standing wave linear accelerator section, and providing RF power to the hybrid linear accelerator to cause acceleration of the charged particles by the standing wave linear accelerator section and the traveling wave linear accelerator section. The method further comprises adjusting the power and/or phase of the RF power in the absorbing RF power remaining after attenuation in the travelling wave section by an adjustable resonant load.

In one example, the method further comprises providing RF power to the traveling wave linear accelerator section by a source of RF power, and providing the RF power remaining after attenuation in the traveling wave section to the standing wave section. The charged particles are accelerated in the standing wave linear accelerator section by the RF power provided to the standing wave section. The RF power and/or phase may be changed by an RF switch, an RF phase shifter, and/or an RF power adjuster.

In another example, the method further comprises providing RF power from the power source to the standing wave linear accelerator section and to the traveling wave linear accelerator section. RF power not used by the traveling wave linear accelerator section is fed to the standing wave linear accelerator section, and/or a phase relationship between the standing wave section and the traveling wave section is changed.

The hybrid linear accelerator of embodiments of the invention can be used for vehicle screening and various cargo screening for security and trade manifest verification (collectively called Security Inspection), non-destructive testing (NDT), and radiotherapy (RT), for example. Embodiments of the invention can also be used in other applications, such as electron beam irradiation of objects of various thicknesses and shapes, such as for curing of composites and electron beam sterilization, for example.

DETAILED DESCRIPTION

Figure 1:
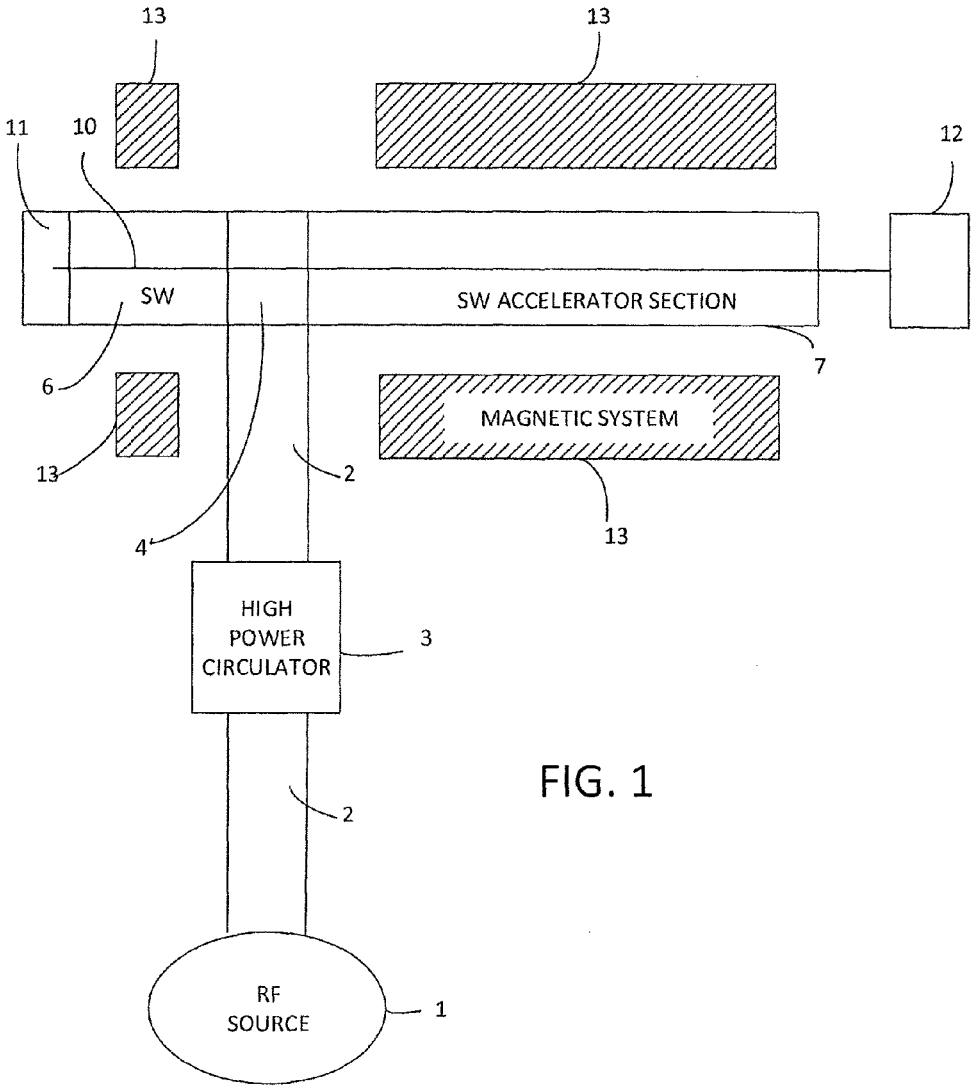
FIG. 1 is a schematic diagram of an example of a traditional standing wave linear accelerator.
Figure 2:
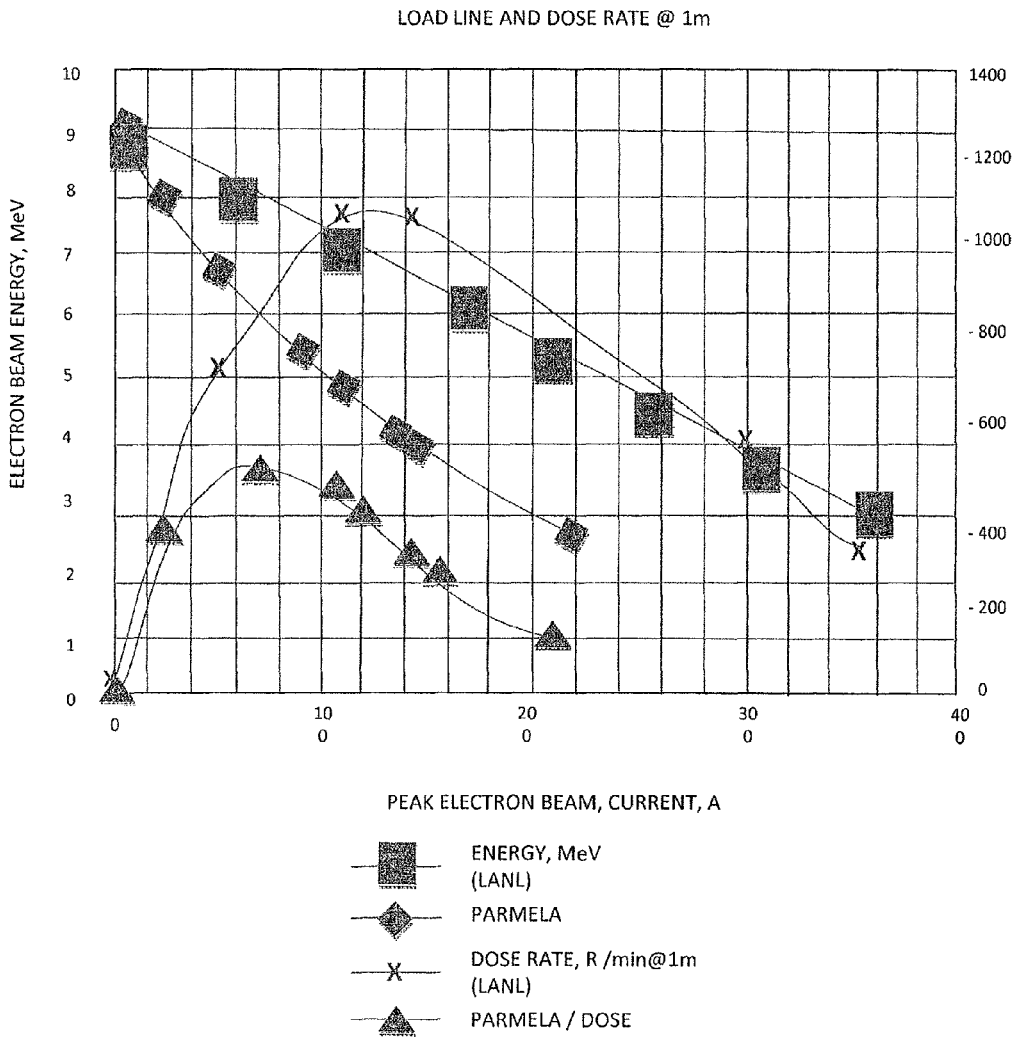
FIG. 2 is a graph of Electron Beam Energy vs. Peak Electron Beam Current showing changes to the linear accelerator load line in comparison with a corrected version based on Parmela simulations of beam dynamic and corresponding dose rate plots in a non-adapted standard single section linear accelerator.
Figure 3:
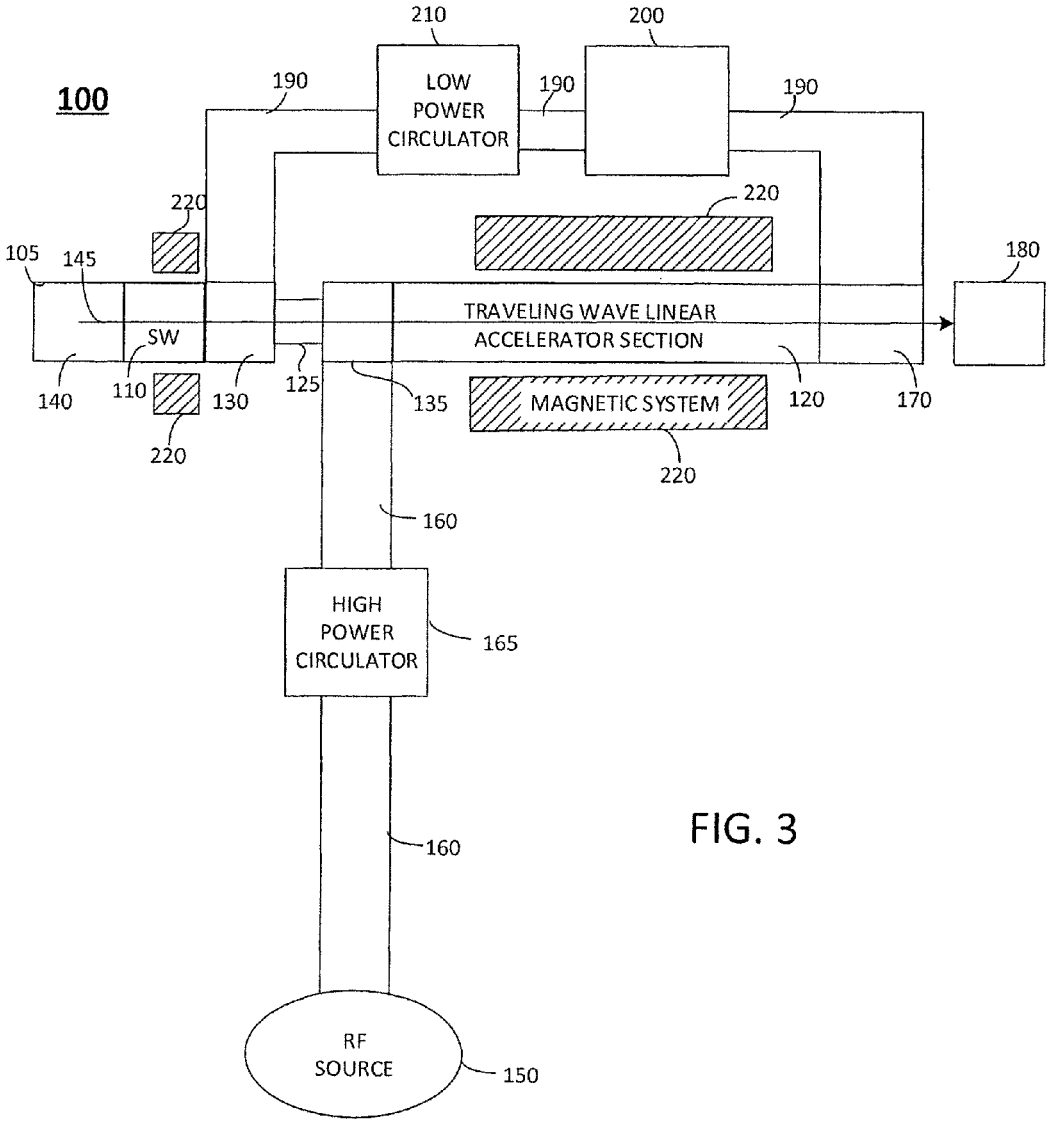
FIG. 3 is a schematic diagram of an example of a hybrid linear accelerator of a first embodiment of the invention, where RF power remaining after attenuation in a traveling wave linear accelerator section is provided to a standing wave section of the hybrid linear accelerator.

FIG. 3 is a schematic diagram of an example of a hybrid linear accelerator system 100 in accordance with an embodiment of the invention. The hybrid linear accelerator system 100 comprises a linear accelerator 105 having a standing wave linear accelerator section 110 and a traveling wave linear acceleration section 120. As discussed above with respect to FIG. 1 and as is known in the art, the linear accelerator 105 includes cavities or cells (not shown) through which RF power propagates to accelerate charged particles, such as electrons. The standing wave linear accelerator section 110 in this example is configured to be a buncher, but that is not required. In this example, the standing wave linear accelerator section 110 is also referred to herein as a "buncher section 110," and the traveling wave linear acceleration section 120 is also referred to herein as a "traveling wave section 120."

A charged particle source 140 is provided to inject a beam of charged particles 145 into the standing wave linear accelerator section 110. The charged particles may be electrons and the charged particle source 140 may be an election gun, for example, as discussed above with respect to FIG. 1. The electron gun 140 may be a triode, diode, or any other type of electron gun. The following discussion will refer to the electron gun 140 but it is understood that other types of charged particles may be injected into the standing wave buncher section 110 by other types of charged particle sources, and accelerated by the hybrid linear accelerator 100 system.

The buncher section 110 and the traveling wave section 120 are connected to each other by a drift tube 125, which provides a path for the passage of accelerated charged particles from the buncher section 110 to the traveling wave section 120. An output of the buncher section 110 is coupled to an input of the drift tube 125 though a first RF coupler 130. The output of the drift tube 125 is coupled to the input of the traveling wave section 120 via a second RF coupler 135. The drift tube 125 is configured to RF decouple the buncher section 110 from the traveling wave linear accelerator section 120, in a manner known in the art.

In accordance with this embodiment of the invention, an RF source 150 provides RF power to the cavities of the traveling wave section 120, via a waveguide 160. In this example, RF power is not provided by the RF source 150 to the standing wave linear accelerator section 110, although that is an option. The second RF coupler 135 couples the waveguide 160 to the interior of the traveling wave section 120 for propagation of the RF power through the interior of the cavities of the traveling wave section. The RF source 150 and the electron gun 140 are powered by one or more power sources (not shown), as is known in the art.

While the RF power source 150 can run RF power into the traveling wave input RF coupler 135 without an isolating device in steady state mode, a high power circulator 160 may be provided between the RF power source 150 and the second RF coupler 135, along the waveguide 160. The high power circulator 160 may be provided at or close to the RF power source, where the propagating RF power is at its highest value.

A third RF coupler 170 is provided at the output of the traveling wave section 120. Accelerated charged particles, such as electrons, pass through a first output of the third RF coupler 170, to a charged particle beam window or conversion target 180, as discussed above with respect to FIG. 1.

During operation of this portion of the linear accelerator system 100, the electron beam 145 may be formed at nx10 KeV, for example. The electron beam 145 is injected into the RF structure of the buncher section 110, where the electron bunches are formed and accelerated to bring the electron beam energy into the MeV range, typically, around 1 MeV. This ensures that bunching is nearly complete and the electron beam 145 becomes close to being fully relativistic, typically, from about 0.85 to about 0.95 times the speed of light. Then, in this example, the electron beam 145 enters the traveling wave section 120 (or traveling wave sections if additional traveling wave sections are provided collinear with the traveling wave section 120), and is accelerated to a higher output energy such as from 4 MeV to 12 MeV, for example. The electrons in the electron beam 145 may be accelerated to lower or to higher energies. In one example, the accelerated electron beam 145 strikes a Bremsstrahlung conversion target 180 to produce X-rays. In another example, the accelerated electron beam 145 passes through an output window 180, such as a thin metal foil, and exits from the vacuum envelope of the accelerator into air or a different environment, such as a different gas or a liquid, water, as is known in the art.

Continuing the description of the linear accelerator system 100, the first, second and third RF couplers 130, 135, and 170 are configured to match the impedance of the external and internal RF circuit to minimize power reflections at the operating RF frequency while running at nominal energy and beam current values. In addition, the high power circulator 165 in this example prevents reflected power from propagating back to the RF source 150. Therefore, most or all of the RF power from the RF power source 150 enters the second RF coupler 135, propagates within the traveling wave linear accelerator section 120 to form an accelerating traveling wave field distribution, and transfers power to the electron beam.

In accordance with this embodiment of the invention, the third RF coupler 170 has a second output connected to an input of a second RF waveguide 190. The output of the second RF waveguide 190 is connected to a second input of the first RF coupler 130. RF power remaining after propagation through the traveling wave linear accelerator section and electron acceleration propagates to the buncher section 110, via the third input coupler 170 and the waveguide 190. The buncher section 110 may replace or render superfluous the RF load commonly used in a linear accelerator to absorb the remaining power coming out of traveling wave linear accelerator section 120, substantially increasing the linear accelerator efficiency.

An RF switch, an RF phase shifter, and/or an RF power adjuster, indicated by block 200 in FIG. 3, may be provided along the second RF waveguide 190 to regulate the power and/or phase of the RF power propagating into the buncher section 110, to change the energy and/or dose of the accelerated electron beam 145 output by the traveling wave linear accelerator section 120 or Bremsstrahlung radiation generated by the system 100. One or more RF switches, RF phase adjusters, and/or RF power adjusters may be provided. The waveguide 190 and the RF switch, phase shifter, and/or power adjuster 200 form a reverse feeding sequence (RFS) to feed the buncher section 110 with RF power remaining after attenuation and electron beam acceleration in the traveling wave section 120, improving the efficiency the linear accelerator 100. The switch, phase shifter, and/or power adjuster is/are outside of the vacuum envelope of the linear accelerator 105.

The power/phase ratio of the RF power provided to the standing wave section 110 may be varied by the RF switch, the RF phase shifter, and/or the RF power adjuster 200 to achieve the desired energy, dose, and/or other output characteristics of the accelerated electron beam 145 or the Bremsstrahlung radiation generated by the system 100. Use of the RF switch, RF phase shifter and/or RF power adjuster 200 in this and other embodiments of the invention described below in conjunction with FIGS. 4 and 5, may be combined with regulation of beam current and/or input power in manners known in the art to further optimize the characteristics of the radiation beam or electron beam output by the accelerator. Broad electron energy regulation, which may comprise setting of the energy/dose within an operating range of the linear accelerator system 100, or switching the energy/dose between two or more energies and/or doses during a scanning procedure within the operating range, may be provided. The operating range of the linear accelerator system 100 may be from about 0.5 MeV to a maximum linear accelerator energy, such as 7 MeV, for example, with a broad range of input RF power and input electron beam current intensities. Different operating ranges, such as ranges with higher maximum energies and/or lower minimum energy levels may be provided.

If the RF switch and/or RF phase shifter are slow or fast devices, electron beams or X-rays may be switched during operation "slowly," when the time of the variation from one energy/dose level is substantially greater than pulse length and/or pulse repetition period, or "fast," such as within times comparable to the pulse length and/or pulse repetition period, including variation within a pulse, and from pulse-to-pulse energy and dose switching (collectively called "fast switching"), respectively. Suitable controls may be provided control the operation and configuration of the RF switch, RF phase shifter, and/or RF power adjuster of the block 200 to set the desired energy/dose or switch between the desired energy/dose during operation.

Appropriate RF switches, RF phase shifters, and RF power adjusters that may be used in the block 200 are commercially available. The RF switch may be an on/off RF switch or an RF switch that switches between energy or phase levels on its own or in conjunction with an RF phase shifter and/or power adjuster, for example. Both fast and slow devices may be provided in the block 200 to provide versatility. The switch of block 200 may be a gas-filled, ferrite or other RF switch known in the art. An example of a fast ferrite switch that may be used is described in G. S. Uebele, "High-Speed ferrite microwave switch, 1957 IRE National Connection Record, Vol. 5, pt. 7, pp. 227-234; Proceedings IRE Transaction on Microwave Theory and Techniques, January 1959, pp. 73-82. The phase shifter of the block 200 may comprise fast and/or slow phase shifters. An appropriate fast phase shifter may be obtained from Ampas GmBH, Grosserlach, Germany, for example.

A low power circulator 210 may be provided along the waveguide 190, between the buncher section 100 and the block 200, for example, to prevent RF power reflected from the buncher section 110 from propagating back to the traveling wave linear accelerator section 120. The circulator 210 is referred to as a "low power" circulator because the RF power in this location is much lower than the RF power provided by the RF source, due to some reflections, attenuation in the traveling wave lines accelerator 120, and power consumed by the electron beam.

A magnetic system 220, such as an external focusing solenoid or a permanent periodic magnet (PPM) system, is optionally provided proximate and in cooperation with the buncher section 110 and/or the traveling wave section 120 to focus the electron beam 145 as it passes through the buncher section 110 and/or the traveling wave section 120. The magnet system 220 may be omitted, because it only provides a small improvement in current transmission and increases complexity, power consumption, and consequently the cost of the hybrid linear accelerator system 100 and other examples of hybrid linear accelerator systems described herein. Simulations of several specific examples demonstrated that use of an external focusing system 220 improved current transmission by only about 20%. RF fields may be used in the buncher section 110 and/or in the traveling wave section 120 to focus and transport the electron beam to the traveling wave section 120, thereby avoiding use of the external magnetic focusing system 13.

This combination of the standing wave and traveling wave sections exploits several advantages of both. For example, the main operational frequency of the linear accelerator is largely defined by the standing wave buncher section 110, while the traveling wave linear accelerator section 120 is more broadband and is easily tuned to the required resonance frequency of the standing wave buncher section. Therefore, automatic frequency control (AFC) may be based on the buncher section 110, which is common for standing wave linear accelerators. If the AFC is only based on the traveling wave section 120, the AFC needs to be much more complex to ensure steady operation of the linear accelerator. In addition, the standing wave buncher section 110 permits effective RF focusing of the electron beam while reaching the relativistic speed, and further acceleration in the traveling wave section 120 can also be used without any external magnetic system, as discussed above.

Exploring a design example of the embodiment of FIG. 3 at 9300 MHz, using a PM-1110X X-band magnetron manufactured by L-3 Electron Devices, San Carlos, Calif., for example, the design parameters for a 60 cm long hybrid RF structure were found to be superior to the existing non-hybrid configurations with similar characteristics. The hybrid RF structure delivered a steady beam at energy in broad energy range of 1 MeV to 7 MeV, with a maximum output dose rate of 1100 R/min at 1 m, which corresponds to over 1700 R/min @ 80 cm, while delivering a substantial dose rate at low energy, estimated in tens of R/min at 1 m. Such a compact linear accelerator system with record high radiation beam characteristics can be useful in many fields, such as Non-Destructive Testing (NDT), Security Screening (SI), Radiation Therapy (RT), etc.

Figure 4:
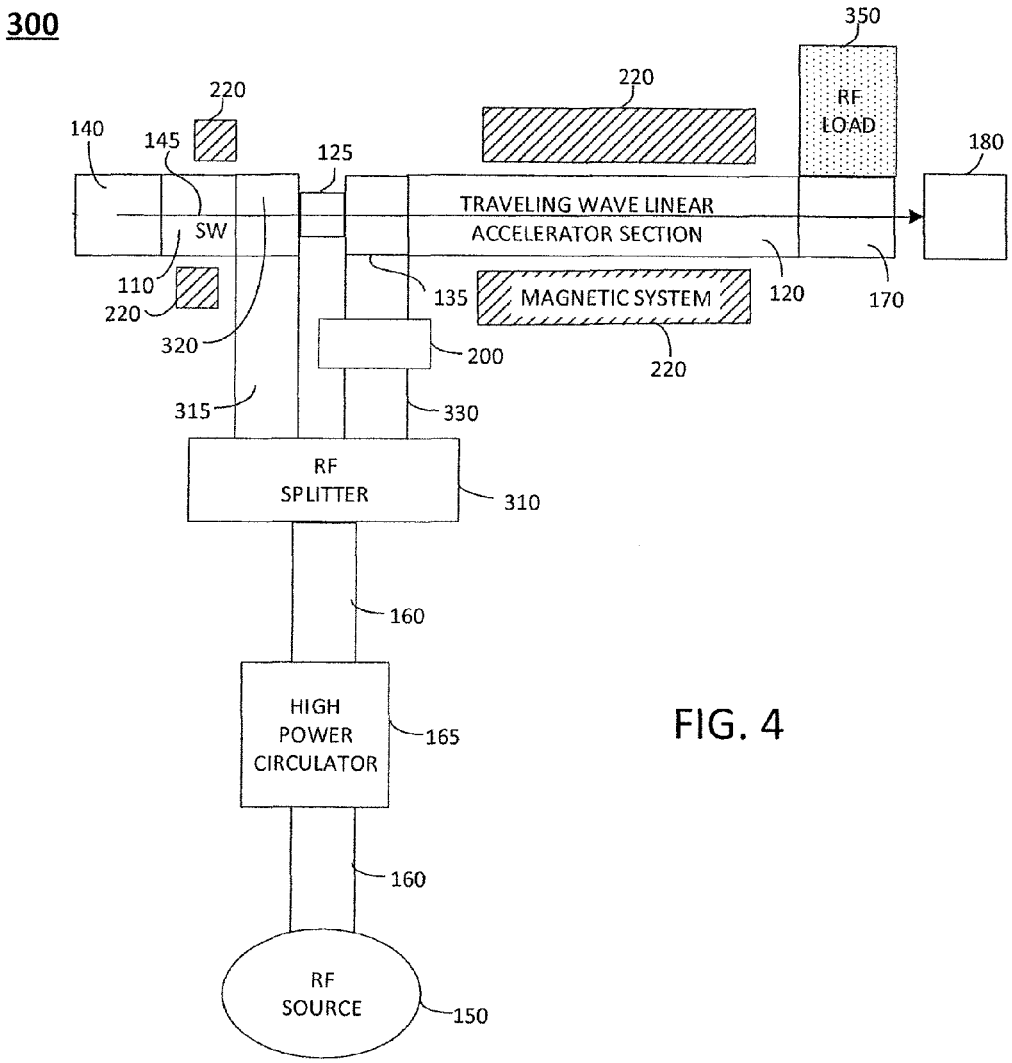
FIG. 4 is a schematic diagram of a hybrid linear accelerator with a parallel RF feed, in accordance with a second embodiment of the invention.

FIG. 4 is a schematic representation of an example of a hybrid linear accelerator in accordance with a second embodiment of the invention, including a parallel RF feed. Items common to FIG. 3 are similarly numbered. The operation and capabilities of this embodiment of the invention are the same as the embodiment of FIG. 3, except as noted herein.

In this example, the buncher section 110 and the traveling wave section 120 are decoupled by the drift tube 125, as in FIG. 3. The RF source 150 provides RF power through an RF transmitting waveguide 160, via a high power circulator 165, which is then split by an RF splitter 310. A portion of the RF power determined by the dividing ratio of the RF splitter 310 is forwarded through a first arm 315 of the RF splitter to a first RF coupler 320 at the output of the buncher section 110. The remaining power is forwarded through the second arm 330 of the RF splitter 310 to the second input RF coupler 135 through RF switch, RF phase shifter, and/or RF power adjuster 340, which may be the same or similar to the block 200 used in the embodiment of FIG. 3.

The RF switch, RF phase shifter, and/or RF power adjuster 340 redistributes RF power between the buncher section 110 and the traveling wave section 120, through the RF splitter 310. The RF energy and/or phase of the RF power redistributed to the buncher section 110 may be changed to set or change the energy and/dose of the intermediate beam of electrons output by the traveling wave linear accelerator section 120. The RF switch, RF phase shifter, and/or RF power adjuster 340 may also be configured to change the phase relationship between the buncher section and the traveling wave section, also setting or changing the energy and/dose of the intermediate beam of electrons output by the traveling wave linear accelerator section 120. Broad energy regulation of the output beam of electrons is thereby provided. As above, the RF switch, RF phase adjuster, and/or RF power adjuster is/are outside of the vacuum envelope of the linear accelerator 105.

In the embodiment of FIG. 4, a matched RF load 350 is provided to absorb RF power remaining after attenuation in the traveling wave accelerator section 120. The remaining RF power in the traveling wave section 120 is coupled to the matched RF load 350 through the RF coupler 170 at an output of the traveling wave section.

The embodiment of FIG. 4 may not be as efficient as the embodiment of FIG. 3, since the remaining RF power is not used. As above, broad electron energy regulation, such as from about 0.5 MeV to a maximum linear accelerator energy, may be achieved while operating in a broad range of input RF power, thereby efficiently running at a variety of input electron beam current intensities at high efficiency.

Figure 5:
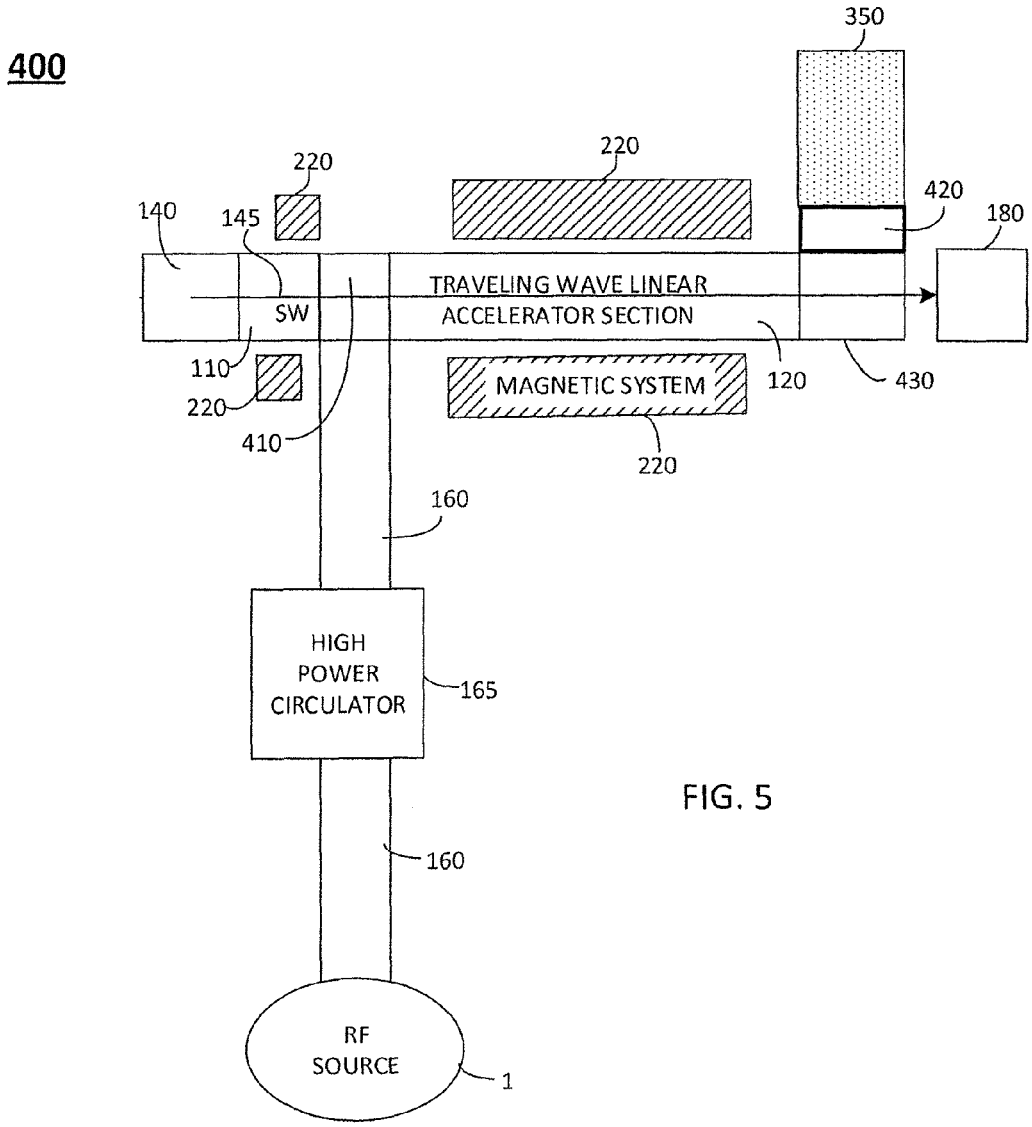
FIG. 5 is a schematic diagram of a hybrid linear accelerator with a single RF feed, in accordance with a third embodiment of the invention.

FIG. 5 is a schematic representation of an example of a hybrid linear accelerator 400 in accordance with a third embodiment of the invention. Items common to FIG. 3 are similarly numbered. The operation and capabilities of this embodiment of the invention are the same as the embodiment of FIG. 3, except as noted herein.

A input RF coupler 410 serves as a combined single RF power input for both the standing wave buncher section 110 and the traveling wave linear accelerator section 120. A drift tube is not provided between the buncher section 110 and the traveling wave section 120 in this embodiment.

A radiation beam parameter RF switch 420 may be provided at the RF output of the traveling wave section 120, after an RF coupler 430. The RF switches discussed above may be used here, for example.

A matched RF load 350, as in FIG. 4, is provided after the radiation beam parameter RF switch 420, to absorb RF power remaining after acceleration in the traveling wave section 120. As above, broad electron energy regulation, such as from about 0.5 MeV to a maximum linear accelerator energy, may be achieved while operating in a broad range of input RF power, thereby efficiently running at a variety of input electron beam current intensities at high efficiency.

While one (1) standing wave linear accelerator (buncher) section 110 and one (1) traveling wave linear accelerator section 120 are shown in the examples above, additional standing wave sections and/or traveling wave sections may can be provided. If additional standing wave sections are provided, in one example only the first standing wave section is configured to be a buncher.

Linear accelerator controls and/or a modulator (not shown) may or may not provide a supplemental method of regulating electron beam current and/or input RF power to support optimization of the linear accelerator in a broad range of its parameters, in the embodiments described above.

Other modifications and implementations will occur to those skilled in the art without departing from the spirit and the scope of the claimed invention. Accordingly, the above description is not intended to limit the invention, except as indicated in the following claims

What is claimed is:

1. A hybrid linear accelerator comprising:

a source of charged particles configured to provide an input beam of charged particles;

a standing wave linear accelerator section configured to receive the input beam of charged particles and accelerate the charged particles, the standing wave linear accelerator section providing an intermediate beam of accelerated electrons;

a traveling wave linear accelerator section configured to receive the intermediate beam of accelerated electrons, and to further increase the momentum and energy of the intermediate beam of accelerated electrons, the traveling wave linear accelerator section providing an output beam of charged particles;

a drift tube configured to provide a path for passage of the intermediate beam from the standing wave linear accelerator section to the traveling wave linear accelerator section, the drift tube configured to RF decouple the standing wave linear accelerator section from the traveling wave linear accelerator section to further increase the momentum and energy of the intermediate beam;

an RF source configured to provide RF power to the traveling wave linear accelerator section; and a first RF waveguide having an input coupled to an output of the traveling wave linear accelerator section and an output coupled to an input of the standing wave linear accelerator section;

wherein RF power remaining after attenuation in the traveling wave linear accelerator section is fed to the standing wave linear accelerator section to accelerate the charged particles.

2. The hybrid linear accelerator of claim 1, further comprising:

a switch, a phase shifter, and/or a power adjuster along the first RF waveguide, to change the power and/or phase of the RF power provided to the standing linear accelerator section.

3. The hybrid linear accelerator of claim 2, wherein the phase shifter, and/or the power adjuster are configured to provide energy regulation of the output beam of electrons of from about 0.5 MeV to a maximum linear accelerator energy.

4. The hybrid linear accelerator of claim 1, wherein the standing wave linear accelerator section is configured in the form of a buncher.

5. The hybrid linear accelerator of claim 1, wherein the source of charged particles comprises an electron gun configured to provide an input beam of electrons.

6. The hybrid linear accelerator of claim 1, further comprising.

a first external magnetic system cooperative with the standing wave linear accelerator section; and/or a second external magnetic system cooperative with the traveling wave linear accelerator section.

7. The hybrid linear accelerator of claim 1, further comprising:

a second RF waveguide between the RF source and traveling wave linear accelerator section configured to provide RF power from the RF source to the traveling wave linear accelerator section; and a high power circulator along the second RF waveguide to prevent reflected RF power from propagating back to the RF source; and/or a low power circulator along the first RF waveguide to prevent reflected RF power from propagating back to the traveling wave linear accelerator section.

8. The hybrid linear accelerator of claim 1, further comprising at least one of:

an charged particle beam window, and a conversion target for producing Bremsstrahlung radiation.

9. A hybrid linear accelerator comprising:

a source of charged particles;

a standing wave linear accelerator section configured to receive the input beam of electrons and accelerate the charged particles, the standing wave linear accelerator section providing an intermediate beam of accelerated charged particles;

a traveling wave linear accelerator section configured to receive the intermediate beam of accelerated charged particles, and to further increase the momentum and energy of the accelerated electrons, the traveling wave linear accelerator section providing an output beam of charged particles;

a drift tube configured to provide RF decoupling between the standing wave linear accelerator section and the traveling wave linear accelerator section, while also permitting transit of the intermediate beam of accelerated electrons from the standing wave linear accelerator section to the traveling wave linear accelerator section;

an RF power source; and an RF splitter configured to receive RF power from the RF power source and to bifurcate the RF power into a first portion of RF power to be provided to the standing wave linear accelerator section and a second portion of RF power to be provided to the traveling wave linear accelerator section.

10. The hybrid linear accelerator of claim 9, further comprising:

an RF switch, an RF phase shifter, and an RF power adjuster between the traveling wave linear accelerator section and the RF splitter, the RF switch, the RF phase shifter, and the RF power adjuster being configured to feed the standing wave standing wave linear accelerator section RF power not used by the traveling wave linear accelerator section, and/or to change a phase relationship between the standing wave linear accelerator section and the traveling wave linear accelerator section.

11. The hybrid linear accelerator of claim 10, wherein the switch, the phase shifter, and/or the power adjuster are configured to provide energy regulation from about 0.5MeV to maximum linear accelerator energy.

12. The hybrid linear accelerator of claim 9, wherein the standing wave linear accelerator section is configured in the form of a buncher.

13. The hybrid linear accelerator of claim 9, wherein:

the source of charged particles comprises an electron gun configured to provide an input beam of electrons.

14. The hybrid linear accelerator of claim 9, further comprising:

a first external magnetic system cooperative with the standing wave linear accelerator section; and/or a second external magnetic system cooperative with the traveling wave linear accelerator section.

15. The hybrid linear accelerator of claim 9, further comprising:

an RF waveguide between the RF source and RF splitter, to provide RF power to the RF splitter; and a high power circulator along the RF waveguide to prevent reflected RF power from propagating back to the RF source.

16. The hybrid linear accelerator of claim 9, further comprising:

a matched RF load coupled to the traveling wave linear accelerator section to absorb RF power remaining after acceleration in the traveling wave linear accelerator section.

17. The hybrid linear accelerator of claim 9, further comprising at least one of:

an charged particle beam window, and a conversion target for producing Bremsstrahlung radiation.

18. A hybrid linear accelerator comprising:

a source of charged particles configured to provide an input beam of electrons;

a standing wave linear accelerator section configured to receive the input beam of charged particles and accelerate the charged particles, the standing wave linear accelerator section providing an intermediate beam of accelerated charged particles;

a traveling wave linear accelerator section configured to receive the intermediate beam of accelerated charged particles, and to further increase the momentum and energy of the accelerated charged particles, the traveling wave linear accelerator section having an output;

an RF coupler configured to provide RF coupling between the standing wave linear accelerator section and the traveling wave linear accelerator section and to allow transit of the intermediate beam of accelerated electrons from the standing wave linear accelerator section to the traveling wave linear accelerator section;

an RF source configured to provide RF power to both the standing wave linear accelerator section and the traveling wave linear accelerator section via an RF waveguide cooperative with the RF coupler; and an RF load cooperative with the output of the traveling wave linear accelerator section; and an RF switch configured to match the RF load with the RF power output by the traveling wave linear accelerator section to absorb power remaining after attenuation in the traveling wave linear accelerator section.

19. The hybrid linear accelerator of claim 18, wherein the standing wave linear accelerator section is configured in the form of a buncher.

20. The hybrid linear accelerator of claim 18, wherein:

the source of charged particles comprises an electron gun configured to provide an input beam of electrons.

21. The hybrid linear accelerator of claim 18, further comprising:

a first external magnetic system cooperative with the standing wave linear accelerator section; and/or a second magnetic system cooperative with the traveling wave linear accelerator section.

22. The hybrid linear accelerator of claim 18, further comprising:

an RF waveguide between the RF source and the RF coupler; and a high power circulator along the RF waveguide to prevent reflected RF power from propagating back to the RF source.

23. The hybrid linear accelerator of claim 18, wherein energy regulation of the output beam of electrons provides energy regulation from about 0.5 MeV to a maximum linear accelerator energy.

24. The hybrid linear accelerator of claim 18, further comprising at least one of:

a charged particle beam window, and a conversion target for producing Bremsstrahlung radiation.

25. A method of accelerating charged particles by a hybrid linear accelerator comprising a standing wave linear accelerator section and a traveling wave linear accelerator section following the standing wave linear accelerator section, the method comprising:

providing charged particles to the standing wave linear accelerator section;

providing RF power to the hybrid linear accelerator to cause acceleration of the charged particles by the standing wave linear accelerator section and the traveling wave linear accelerator section; and adjusting RF power and/or phase in at least a portion of the hybrid linear accelerator to regulate energy and/or dose of a beam of accelerated charged particles output by the traveling wave linear accelerator section.

26. The method of claim 25, further comprising:

providing RF power to the traveling wave linear accelerator section by a source of RF power;

providing the RF power remaining after attenuation in the traveling wave section to the standing wave section; and accelerating the charged particles in the standing wave linear accelerator section by the RF power provided to the standing wave linear accelerator section.

27. The method of claim 25, further comprising:

adjusting the RF power and/or phase of the RF power provided to the standing wave linear accelerator section by an RF switch, an RF phase shifter, and/or an RF power adjuster to regulate energy and/or dose of the beam of accelerated charged particles output by the traveling wave linear accelerator section.

28. The method of claim 27, wherein providing RF power to the hybrid linear accelerator comprises:

providing RF power to the standing wave linear accelerator section and to the travelling wave linear accelerator section from a source of RF power; and adjusting the RF power and/or phase of the RF power provided to the travelling wave linear accelerator section to regulate energy and/or dose of a beam of accelerated charged particles output by the traveling wave linear accelerator section.

* * * * *